US009091121B2

(12) United States Patent
Zhou

(10) Patent No.: US 9,091,121 B2
(45) Date of Patent: Jul. 28, 2015

(54) INFLATABLE PACKER ELEMENT FOR USE WITH A DRILL BIT SUB

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 130 days.

(21) Appl. No.: 13/706,604

(22) Filed: Dec. 6, 2012

(65) Prior Publication Data

US 2013/0161100 A1 Jun. 27, 2013

Related U.S. Application Data

(60) Provisional application No. 61/580,049, filed on Dec. 23, 2011.

(51) Int. Cl.

| | |
|---|---|
| ***E21B 7/00*** | (2006.01) |
| ***E21B 33/127*** | (2006.01) |
| ***E21B 43/26*** | (2006.01) |
| ***E21B 17/16*** | (2006.01) |

(52) U.S. Cl.
CPC . *E21B 7/00* (2013.01); *E21B 17/16* (2013.01); *E21B 33/127* (2013.01); *E21B 43/26* (2013.01)

(58) Field of Classification Search
CPC ..... E21B 43/26; E21B 21/10; E21B 33/127; E21B 7/18; E21B 21/08; E21B 7/00
USPC ..... 166/308.1, 177.5, 185; 175/230, 317, 175/214
See application file for complete search history.

(56) References Cited

U.S. PATENT DOCUMENTS

| | | | | |
|---|---|---|---|---|
| 2,511,759 | A | | 6/1950 | Williams |
| 2,663,545 | A | * | 12/1953 | Grable ..... 166/264 |
| 2,783,026 | A | * | 2/1957 | Reistle, Jr. ..... 166/308.1 |
| 3,809,157 | A | * | 5/1974 | Dufrene ..... 166/185 |
| 3,876,000 | A | | 4/1975 | Nutter |
| 4,588,035 | A | | 5/1986 | Van Gils et al. |
| 5,050,690 | A | * | 9/1991 | Smith ..... 175/50 |
| 5,799,733 | A | | 9/1998 | Ringgenberg et al. |
| 6,236,620 | B1 | | 5/2001 | Schultz et al. |

(Continued)

OTHER PUBLICATIONS

PCT International Search Report and the Written Opinion of the International Searching Authority dated Feb. 17, 2014; International Application No. PCT/US2012/070452; International File Date: Dec. 19, 2012.

(Continued)

*Primary Examiner* — Daniel P Stephenson
(74) *Attorney, Agent, or Firm* — Bracewell & Giuliani LLP; Constance Gall Rhebergen; Keith R. Derrington

(57) ABSTRACT

A system for use in a subterranean wellbore includes an earth boring bit on a lower end of a drill string, and an inflatable packer system. The packer system includes a pressure activated inlet valve that regulates pressurized fluid from within the drill string to the packer for inflating the packer. The inlet valve opens above a pressure used for drilling and includes a piston and spring disposed in a cylinder; the spring provides a biasing force against the piston and positions the piston between the annulus and an inlet port to the packer. When inflated, the packer extends radially outward from the drill string and into sealing engagement with an inner surface of the wellbore.

15 Claims, 3 Drawing Sheets

(56) References Cited

U.S. PATENT DOCUMENTS

| | | | | |
|---|---|---|---|---|
| 7,093,674 | B2 | 8/2006 | Paluch et al. | |
| 7,516,792 | B2 | 4/2009 | Lonnes et al. | |
| 7,963,325 | B2 * | 6/2011 | Johnson et al. | 166/250.1 |
| 2003/0141055 | A1 | 7/2003 | Paluch et al. | |
| 2003/0150614 | A1 | 8/2003 | Brown et al. | |
| 2003/0234120 | A1 | 12/2003 | Paluch et al. | |
| 2005/0230107 | A1 * | 10/2005 | McDaniel et al. | 166/249 |
| 2009/0095474 | A1 | 4/2009 | Lesso et al. | |
| 2009/0145660 | A1 | 6/2009 | Johnson et al. | |
| 2009/0151938 | A1 | 6/2009 | Conkle et al. | |
| 2010/0307773 | A1 | 12/2010 | Tinnen et al. | |
| 2011/0198097 | A1 | 8/2011 | Moen | |
| 2013/0161100 | A1 * | 6/2013 | Zhou | 175/230 |

OTHER PUBLICATIONS

U.S. Appl. No. 13/714,485, filed Dec. 14, 2012; System and Method of Fracturing While Drilling.

U.S. Appl. No. 13/711,693, filed Dec. 12, 2012; Drill Bit For Use In Boring A Wellbore And Subterranean Fracturing.

U.S. Appl. No. 13/706,902, filed Dec. 6, 2012; Method of Fracturing While Drilling.

* cited by examiner

INFLATABLE PACKER ELEMENT FOR USE WITH A DRILL BIT SUB

CROSS REFERENCE TO RELATED APPLICATIONS

This application claims priority to and the benefit of U.S. Provisional Application Ser. No. 61/580,049, filed Dec. 23, 2011, the full disclosure of which is hereby incorporated by reference herein for all purposes.

BACKGROUND OF THE INVENTION

1. Field of the Invention

The present invention relates to an inflatable packer for use an earth boring bit assembly. More specifically, the invention relates to a packer that selectively deploys in response to an increase in a pressure of fluid being delivered to the bit assembly; where the inflated packer forms a sealed space for fracturing a subterranean formation.

2. Description of the Related Art

Hydrocarbon producing wellbores extend subsurface and intersect subterranean formations where hydrocarbons are trapped. The wellbores generally are created by drill bits that are on the end of a drill string, where typically a drive system above the opening to the wellbore rotates the drill string and bit. Provided on the drill bit are cutting elements that scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore. Cuttings produced while excavating are carried up the wellbore with the circulating drilling fluid.

Sometimes fractures are created in the wall of the wellbore that extend into the formation adjacent the wellbore. Fracturing is typically performed by injecting high pressure fluid into the wellbore and sealing off a portion of the wellbore. Fracturing generally initiates when the pressure in the wellbore exceeds the rock strength in the formation. The fractures are usually supported by injection of a proppant, such as sand or resin coated particles. The proppant is generally also employed for blocking the production of sand or other particulate matter from the formation into the wellbore.

SUMMARY OF THE INVENTION

Described herein is an example embodiment a system for use in a subterranean wellbore. In an example the system includes an earth boring bit on an end of a string of drill pipe, where the combination of the bit and drill pipe defines a drill string. This example of the system also includes a seal assembly on the drill string that is made up of a seal element, a flow line between an axial bore in the drill string and the seal element, and an inlet valve in the flow line that is moveable to an open configuration when a pressure in the drill string exceeds a pressure for earth boring operations. The seal element is in fluid communication with the annular space in the pipe string and the seal element expands radially outward into sealing engagement with a wall of the wellbore. A fracturing port is included between an end of the bit that is distal from the string of drill pipe and the seal, and that selectively moves to an open position when pressure in the drill string is at a pressure for fracturing formation adjacent the wellbore. The inlet valve can include a shaft radially formed through a sidewall of the drill string having an end facing the bore in the drill string and that defines a cylinder, a piston coaxially disposed in the cylinder, a passage in the drill string that intersects the cylinder and extends to an outer surface of the drill string facing the seal element, and a spring in an end of the cylinder that biases the piston towards the end of the cylinder facing the bore in the drill string. The spring may become compressed when pressure in the drill string is above the pressure for earth boring operations. The piston can be moved in the cylinder from between the bore in the drill string and where the passage intersects the cylinder to define a closed configuration of the inlet valve, to an opposing side of where the passage intersects the cylinder to define the open configuration. The system can further include a collar on the drill string mounted on an end of the bit that adjoins the string of drill pipe. In this example the seal element include an annular membrane having lateral ends affixed to opposing ends of the collar. Optionally, the inlet valve is disposed in the collar. In an example, pressure in the cylinder on a side of the piston facing away from the bore in the drill string is substantially less than the pressure for earth boring operations, so that the inlet valve is in the open configuration when fluid flows through the inlet valve from adjacent the seal element and to the bore in the drill string.

Also disclosed herein is an example of earth boring bit for use in a subterranean wellbore. In one example the bit includes a body, a connection on the body for attachment to a string of drill pipe, a packer on the body adjacent to the connection, and an inlet valve having an element that is selectively moveable from a closed position and defines a flow barrier between an inside of the drill pipe and packer. The element is also moveable to an open position, where the inside of the drill pipe is in communication with the packer. In one example the element is a piston and is moveable in a cylindrically shaped space formed in the body. The bit can further include a spring in the cylindrically shaped space on a side of the piston distal from the inside of the drill pipe and a passage formed in the body that is in communication with the cylindrically shaped space and an inside of the packer. In one alternative the spring exerts a biasing force on the piston to retain the piston in the closed position when pressure in the inside of the drill pipe is at about a pressure for a drilling operation, and wherein the biasing force is overcome when pressure in the inside of the drill pipe is a designated value greater than the pressure for the drilling operation. The earth boring bit can further include a fracturing port on an outer surface of the body and a drilling nozzle on an outer surface of the body, wherein the fracturing port is in communication with the inside of the drill pipe when the inlet valve is in the open position, and wherein the drilling nozzle is in communication with the inside of the drill pipe when the inlet valve is in the closed position.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
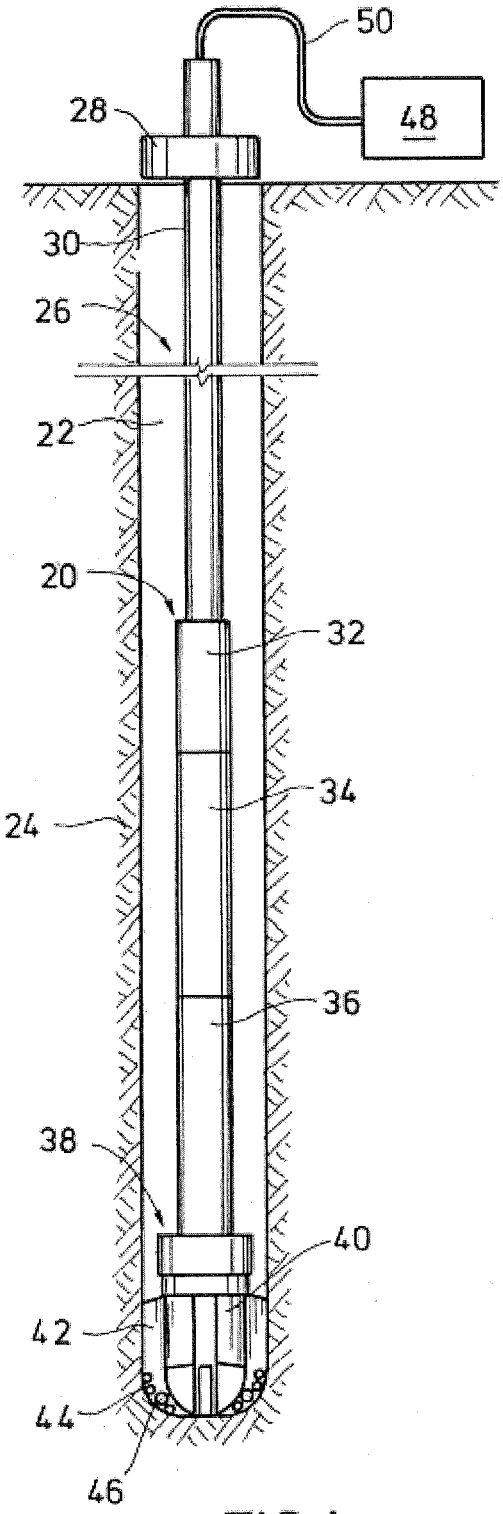
FIG. 1 is a side partial sectional view of an example embodiment of forming a wellbore using a drilling system with a drill bit assembly in accordance with the present invention.

An example embodiment of a drilling system 20 is provided in a side partial sectional view in FIG. 1. The drilling system 20 embodiment is shown forming a wellbore 22 through a formation 24 with an elongated drill string 26. Rotational force for driving the drill string 26 can be provided by a drive system 28 shown schematically represented on the surface and above an opening of the wellbore 22. Examples of the drive system 28 include a top drive as well as a rotary table. A number of segments of drill pipe 30 threadingly attached together form an upper portion of the drill string 26. An optional swivel master 32 is schematically illustrated on a lower end of the lowermost drill pipe 30. The swivel master 32 allows the portion of the drill string 26 above the swivel master 32 to be rotated without any rotation or torque being applied to the string 26 below the swivel master 32. The lower end of the swivel master 32 is shown connected to an upper end of a directional drilling assembly 34; where the directional drilling assembly 34 may include gyros or other directional type devices for steering the lower end of the drill string 26. Also optionally provided is an intensifier 36 coupled on a lower end of the directional drilling assembly 34.

In one example, the pressure intensifier 36 receives fluid at an inlet adjacent the drilling assembly 34, increases the pressure of the fluid, and discharges the fluid from an end adjacent a drill bit assembly 38 shown mounted on a lower end of the intensifier 36. In an example, the fluid pressurized by the intensifier 36 flows from surface through the drill string 26. The bit assembly 38 includes a drill bit 40, shown as a drag or fixed bit, but may also include extended gauge rotary cone type bits. Cutting blades 42 extend axially along an outer surface of the drill bit 40 and are shown having cutters 44. The cutters 44 may be cylindrically shaped members, and may also optionally be formed from a polycrystalline diamond material. Further provided on the drill bit 40 of FIG. 1 are nozzles 46 that are dispersed between the cutters 44 for discharging drilling fluid from the drill bit 40 during drilling operations. As is known, the fluid exiting the nozzles 46 provides both cooling of cutters 44 due to the heat generated with rock cutting action and hydraulically flushes cuttings away as soon as they are created. The drilling fluid also recirculates up the wellbore 22 and carries with it rock formation cuttings that are formed while excavating the wellbore 22. The drilling fluid may be provided from a storage tank 48 shown on the surface that leads the fluid into the drill string 26 via a line 50.

Figure 2:
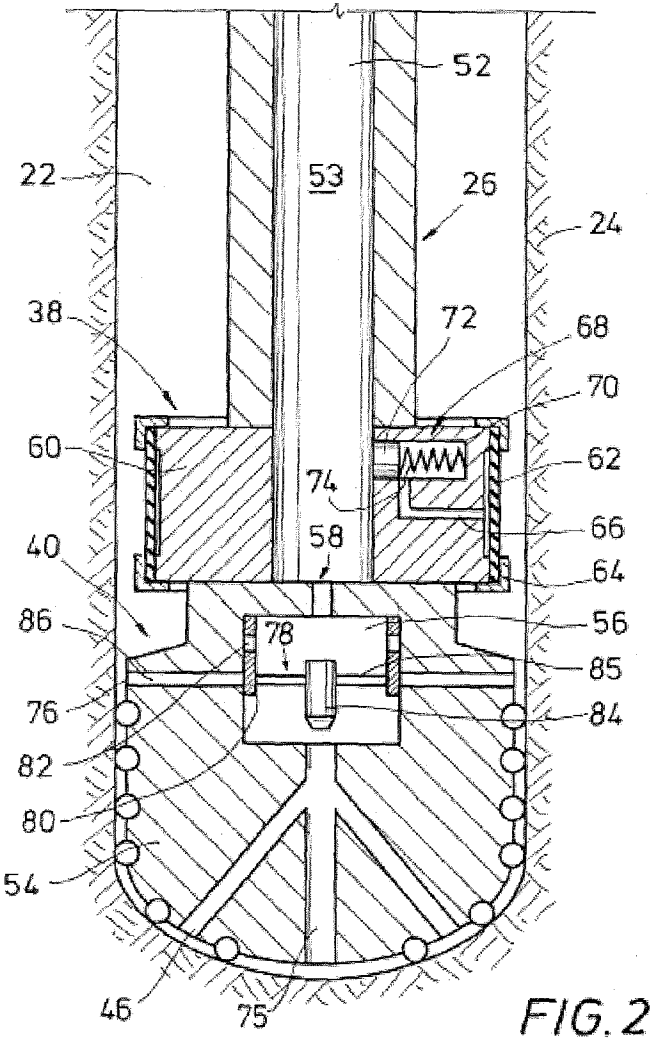
FIG. 2 is a side sectional view of an example of the drill bit assembly of FIG. 1 and having an inflatable packer in accordance with the present invention.

Shown in more detail in a side sectional view in FIG. 2 is an example embodiment of the drill bit assembly 38 and lower portion of the drill string 26 of FIG. 1. In the example of FIG. 2, an annulus 52 is provided within the drill string 26 and is shown directing fluid 53 from the tank 48 (FIG. 1) and towards the bit assembly 38. The drill bit 40 of FIG. 2 includes a body 54 in which a fluid chamber is formed 56. The chamber 56 is in fluid communication with the annulus 52 via a port 58 formed in an upper end of the body 54. Also provided on an upper end of the bit 40 is an annular collar 60 shown having a substantially rectangular cross-section and coaxial with the drill string 26. Thus, in one example, the drill bit assembly 38 made up of the collar 60 and drill bit 40 may be referred to as a drill bit sub. A packer 62 is shown provided on an outer radial periphery of the collar 62 and is an annular like element that is substantially coaxial with the collar 60. In the example of FIG. 2, the packer 62 includes a generally membrane-like member that may be formed from an elastomer-type material. Packer mounts 64 are schematically represented on upper and lower terminal ends of the packer 62 that are for securing the packer 62 onto the collar 60. The packer mounts 64 are shown in FIG. 2 as being generally ring-like members, a portion of which that depends radially inward respectively above and below the collar 60 and packer 62. Each of the mounts 64 have an axially depending portion that overlaps the outer radial edges of the packer 62.

Selective fluid communication between the annulus 52 and within the packer 62 may be provided by a passage 66 shown extending through the body of the collar 60. A packer inlet valve 68 is shown disposed in a cylinder 70 shown formed in the body of the collar 60. In the cylinder 70, the inlet valve 68 is between an inlet of the passage 66 and annulus 52. The packer inlet valve 68 selectively allows fluid communication between the annulus and within the packer 62 for inflating the packer 62, which is described in more detail below. The cylinder 70 is shown having an open end facing the annulus 52 and a sidewall intersected by the passage 66. A piston 72 is shown provided in the cylinder 70, wherein the piston 72 has a curved outer circumference formed to contact with the walls of the cylinder 70 and form a sealing interface between the piston 72 and cylinder 70. A spring 74 shown in the cylinder 70 and on a side of the piston 72 opposite the annulus 52. The spring 74 biases the piston 72 in a direction towards the annulus 52 thereby blocking flow from the annulus 52 to the passage 66 when in the configuration of FIG. 2.

Still referring to FIG. 2, the nozzles 46 are depicted in fluid communication with the chamber 56 via passages 75 that extend from the chamber 56 into the nozzles 46. Fracturing ports 76 are also shown in fluid communication with the chamber 56. As will be described below, the fracturing ports 76 are for delivering fracturing fluid from the drill bit 40 to the wellbore 22. A valve assembly 78 is schematically illustrated within the chamber 56 for selectively providing flow to the nozzles 46 or to the fracturing port(s) 76. More specifically, the valve assembly 78 is shown having an annular sleeve 80 that slides axially within the chamber 56. Apertures 82 are further illustrated that are formed radially through the sleeve 80. An elongated plunger 84 is further shown in the chamber 56 and coaxially mounted in the sleeve 80 by support rods 85 that extend radially from the plunger 84 to attachment with an inner surface of the sleeve 80. In the example of FIG. 2, the chamber 56 is in selective fluid communication with the fracturing ports 76 via frac lines 86 that extend radially outward through the body 54 from the chamber 56. In the example of FIG. 2, the sleeve 80 is positioned to adjacent openings to the frac lines 86 thereby blocking flow from the chamber 56 to the fracturing ports 76.

In one example of the embodiment of FIG. 2, the fluid 53 is at a pressure typical for drilling the borehole 22. Moreover, the fluid 53 flows through the chamber 56, through the passages 75 where it exits the nozzles 76 and recirculates back up the wellbore 22 into the surface. Example pressures of the fluid 53 in the annulus 52 while drilling may range from about 5,000 psi and upwards of about 10,000 psi. As is known though, these pressures when drilling are dependent upon many factors, such as depth of the bottom hole, drilling mud density, and pressure drops through the bit.

Figure 3:
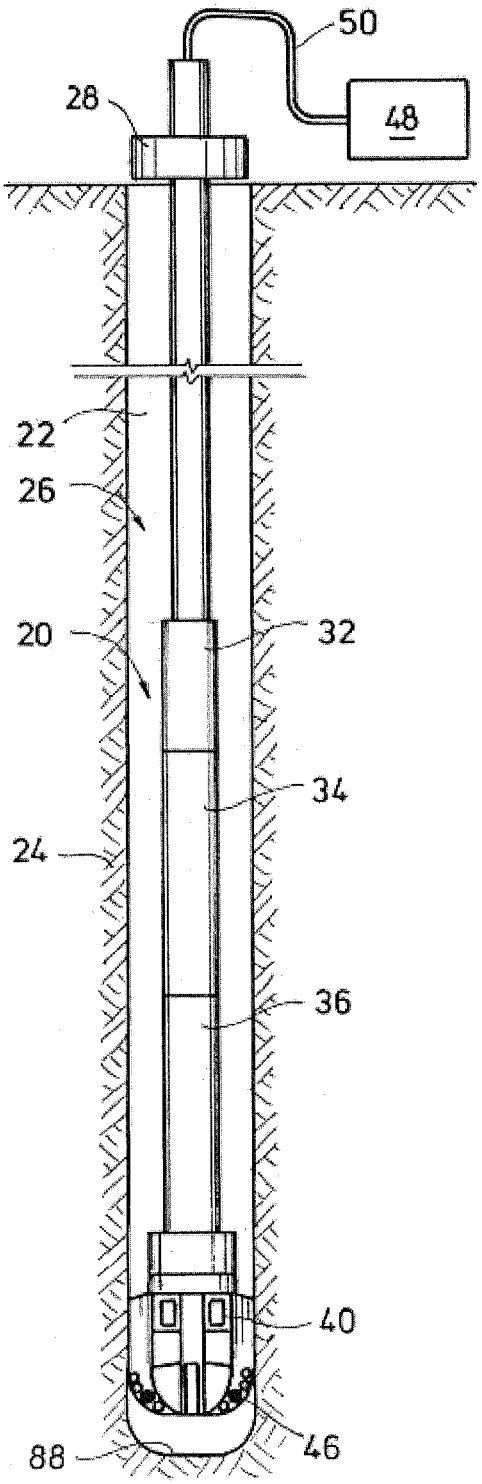
FIG. 3 is a side partial sectional view of the example of FIG. 1 transitioning from drilling a wellbore to fracturing a formation in accordance with the present invention.

Referring now to FIG. 3, shown in a side partial sectional view is an example of the drill string 26 being drawn vertically upward a short distance from the wellbore bottom 88; wherein the distance may range from less than a foot up to about 10 feet. Optionally, the lower end of the bit 40 can be set upward from the bottom 88 at any distance greater than about 10 feet. The optional step of upwardly pulling the drill string 26 so the bit 40 is spaced back from the wellbore bottom 88 allows for pressurizing a portion of the wellbore 22 so that a fracture can be created in the formation 24 adjacent that selected portion of the wellbore 22.

Figure 4:
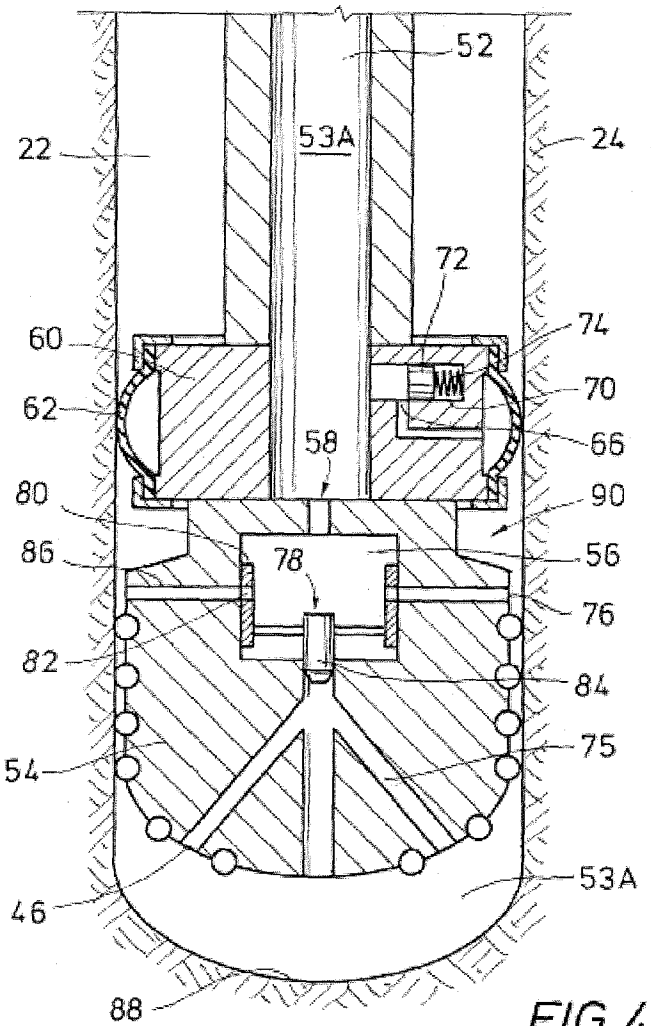
FIG. 4 is a side partial sectional view of an example of the bit of FIG. 2 during a fracturing sequence in accordance with the present invention.

FIG. 4 shows in a side sectional view an example of deploying the packer 62, by inflating the packer 62 so that it expands radially outward into contact with an inner surface of the wellbore 22. In the example of FIG. 4, the pressure of the fluid 53A in annulus 52 is increased above that of the pressure during the steps of drilling (FIG. 2). In one example, the pressure of the fluid 53A in FIG. 4 can be in excess of 20,000 psi. However, similar to variables affecting fluid pressure while drilling, the fluid pressure while fracturing can depend on factors such as depth, fluid makeup and the zone being fractured. Further illustrated in the example of FIG. 4 is that the pressure in the annulus 52 sufficiently exceeds the pressure in passage 66 so that the differential pressure is formed on the piston 72 and overcomes the force exerted by the spring 74 on the piston 72. As such, the piston 72 is shown urged radially outward within the cylinder 70 and past the inlet to the passage 66 so that fluid 53A makes its way into the packer 62 through passage 66 for inflating the packer 62 into its deployed configuration shown. When deployed, the packer 62 defines a sealed space 90 between the packer 62 and wellbore bottom 88. As indicated above, the valve assembly 78 selectively diverts flow either out of the nozzles 46 or the fracturing ports 76. Inlet valve 68 actuates when pressure in the annulus 52 exceeds a pressure that takes place during drilling operations. In one example, the pressure to actuate the inlet valve 68 is about 2000 psi greater than drilling operation pressure. The pressure increase of the fluid can be generated by pumps (not shown) on the surface that pressurize fluid in tank 48 or from the intensifier 36 (FIG. 1).

Figure 5:
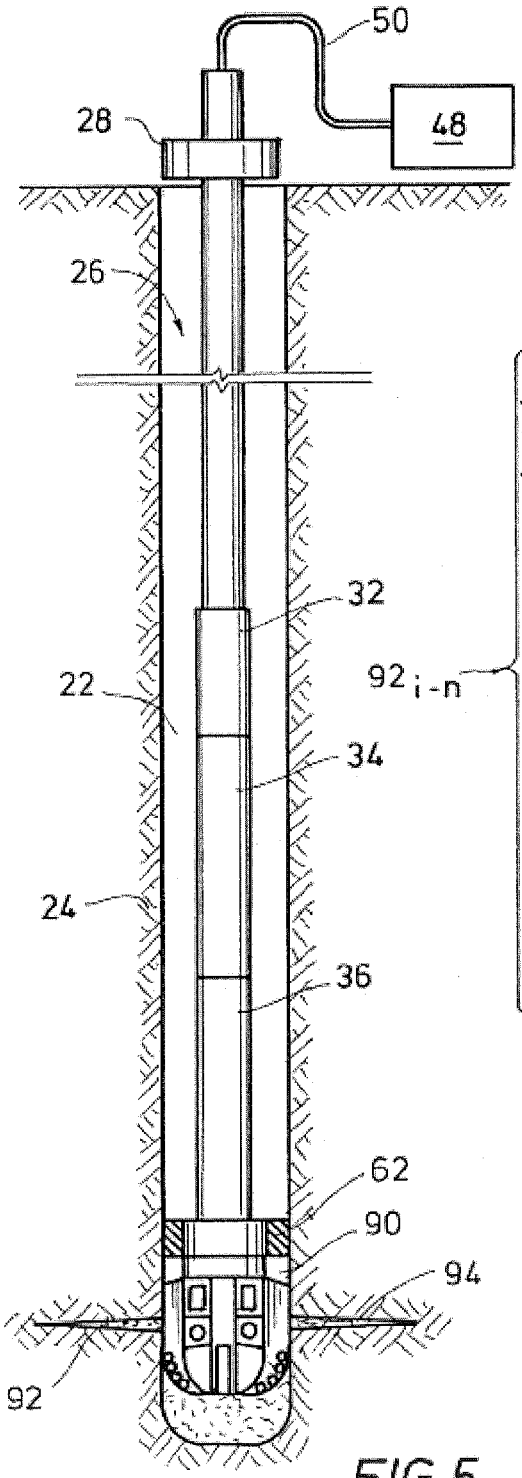
FIG. 5 is a side partial sectional view of an example of the drilling system of FIG. 1 with an inflated packer during a fracturing sequence in accordance with the present invention.

In the example of FIG. 4, the valve assembly 78 is moved downward so that a lower end of plunger 84 inserts into an inlet of the passages 75. Inserting the plunger 84 into the inlet of passage 75 blocks communication between chamber 56 and passage 75. Apertures 82 are strategically located on sleeve 80 so that when the plunger 84 is set in the inlet to the passage 75, apertures 82 register with frac lines 86 to allow flow from the chamber 56 to flow into the space 90. Thus when apertures 82 register with frac lines 86 and pressure in the chamber 56 exceeds pressure in space 90, frac fluid flow from the chamber 56, through the aperture 82 and passage 86, and exits the fracturing port 76. The fluid 53A fills the sealed space 90 and thereby exerts a force onto the formation 24 that ultimately overcomes the tensile stress in the formation 24 to create a fracture 92 shown extending from a wall of the wellbore 22 and into the formation 24 (FIG. 5). Further, fracturing fluid 94, which may be the same or different from fluid 53A, is shown filling fracture 92. In an example, the cross sectional area of frac lines 86 is greater than both nozzles 46 and passages 75, meaning fluid can be delivered to space 90 via frac lines 86 with less pressure drop than via nozzles 46 and passages 75. Also, fracturing fluid is more suited to larger diameter passages. As such, an advantage exists for delivering fracturing fluid through frac lines 86 over that of nozzles 46 and passages 75.

Figure 6:
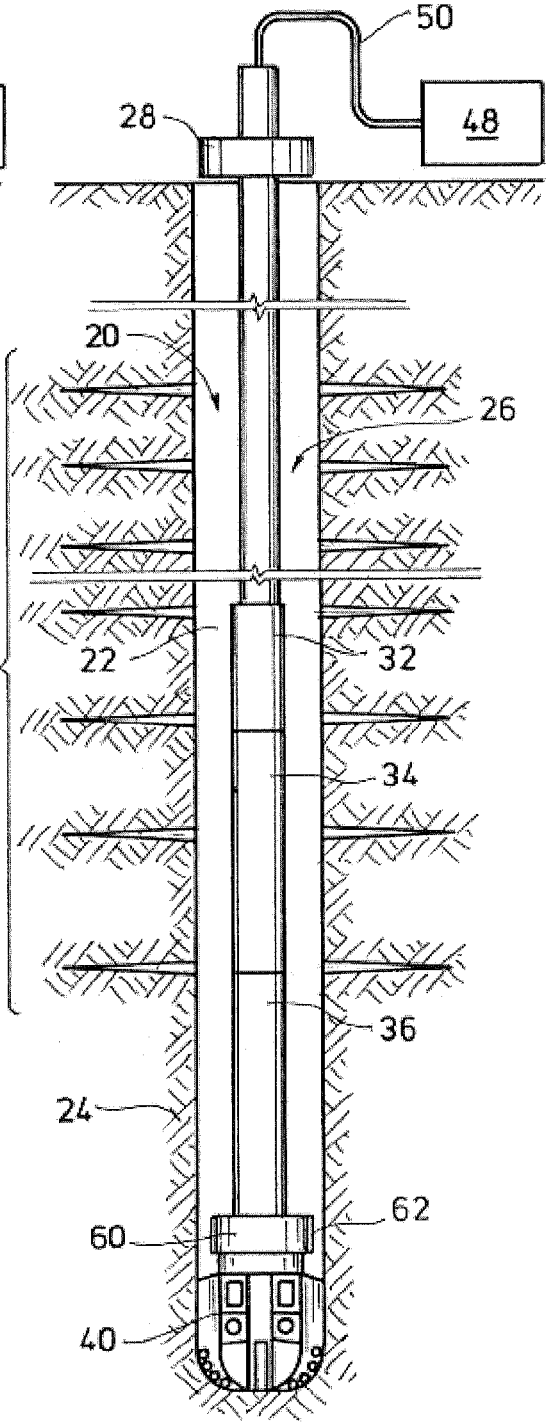
FIG. 6 is a side partial sectional view of an example of the drilling system and drill bit of FIG. 5 in a wellbore having fractures in multiple zones in accordance with the present invention.

Optionally as illustrated in FIG. 6, the drilling system 20, which may also be referred to as a drilling and fracturing system, may continue drilling after forming a first fracture 92 (FIG. 5) and create additional fractures. As such, in the example of FIG. 6 a series of fractures $\mathbf{92}_{1-n}$ are shown formed at axially spaced apart locations within the wellbore 22. Further illustrated in the example of FIG. 6 is that the packer 62 has been retracted and stowed adjacent the collar 60 thereby allowing the bit 40 to freely rotate and further deepen the wellbore 22. Slowly bleeding pressure from fluid in the drill string 26 after each fracturing operation can allow the packer 62 to deflate so the bit 40 can be moved within the wellbore 22.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for use in a subterranean wellbore comprising:

an earth boring bit coupled to an end of a string of drill pipe to define a drill string;

a seal assembly on a body of the earth boring bit comprising, a seal element;

a flow line between an axial bore in the drill string and the seal element, and an inlet valve in the flow line that is moveable to an open configuration when a pressure in the drill string exceeds a pressure for earth boring operations, so that the seal element is in fluid communication with the annular space in the pipe string and the seal element expands radially outward into sealing engagement with a wall of the wellbore;

a fracturing port between an end of the bit that is distal from the string of drill pipe and the seal: and a fracturing valve in the bit adjacent the fracturing port and that selectively changes to an open configuration when the inlet valve is in the open configuration and opens fluid communication between the annular space in the pipe string and the fracturing port.

2. The system of claim 1, wherein the inlet valve comprises a shaft radially formed through a sidewall of the drill string having an end facing the bore in the drill string and that defines a cylinder, a piston coaxially disposed in the cylinder, a passage in the drill string that intersects the cylinder and extends to an outer surface of the drill string facing the seal element, and a spring in an end of the cylinder that biases the piston towards the end of the cylinder facing the bore in the drill string.

3. The system of claim 2, wherein the spring becomes compressed when pressure in the drill string is above the pressure for earth boring operations.

4. The system of claim 2, wherein the piston is moveable in the cylinder from between the bore in the drill string and where the passage intersects the cylinder to define a closed configuration of the inlet valve, to an opposing side of where the passage intersects the cylinder to define the open configuration.

5. The system of claim 2, further comprising a collar that connects between the drill and an end of the bit that adjoins the string of drill pipe, wherein the seal element comprises an annular membrane having lateral ends affixed to opposing ends of the collar.

6. The system of claim 5, wherein the inlet valve is disposed in the collar.

7. The system of claim 2, wherein pressure in the cylinder on a side of the piston facing away from the bore in the drill string is substantially less than the pressure for earth boring operations, so that the inlet valve is in the open configuration when fluid flows through the inlet valve from adjacent the seal element and to the bore in the drill string.

8. The system of claim 1, wherein the drill string further comprises a swivel master, a directional drilling assembly, and an intensifier that are disposed between the drill pipe and drill bit.

9. An earth boring bit for use in a subterranean wellbore comprising:

a body;

a connection on the body for attachment to a string of drill pipe;

a drilling nozzle on the body that is in selective communication with an annulus in the drill pipe;

a fracturing port on the body that is in selective communication with the annulus;

a packer on the body adjacent to the connection that is selectively inflated to a deployed configuration so that an outer circumference of the packer expands radially outward and into sealing contact with an inner surface of the wellbore to create a sealed space in the wellbore that has an axial length that is the same as a length of the body; and an inlet valve comprising an element that is selectively moveable from a closed position defining a flow barrier between an inside of the drill pipe and packer to an open position so that the inside of the drill pipe is in communication with the packer.

10. The earth boring bit of claim 9, wherein the element comprises a piston and is moveable in a cylindrically shaped space formed in the body.

11. The earth boring bit of claim 10, further comprising a spring in the cylindrically shaped space on a side of the piston distal from the inside of the drill pipe and a passage formed in the body that is in communication with the cylindrically shaped space and an inside of the packer.

12. The earth boring bit of claim 11, wherein the spring exerts a biasing force on the piston to retain the piston in the closed position when pressure in the inside of the drill pipe is at about a pressure for a drilling operation, and wherein the biasing force is overcome when pressure in the inside of the drill pipe is a designated value greater than the pressure for the drilling operation.

13. The earth boring bit of claim 9, further comprising a fracturing port on an outer surface of the body and a drilling nozzle on an outer surface of the body, wherein the fracturing port is in communication with the inside of the drill pipe when the inlet valve is in the open position, and wherein the drilling nozzle is in communication with the inside of the drill pipe when the inlet valve is in the closed position.

14. The earth boring bit of claim 13, further comprising a valve assembly in the body that selectively diverts flow in the bit so that flow exits the bit from one of the drilling nozzle or the fracturing port.

15. The earth boring bit of claim 13, wherein the fracturing port has a cross sectional area that is greater than a cross sectional area of the drilling nozzle.

* * * * *

UNITED STATES PATENT AND TRADEMARK OFFICE

CERTIFICATE OF CORRECTION

PATENT NO. : 9,091,121 B2
APPLICATION NO. : 13/706604
DATED : July 28, 2015
INVENTOR(S) : Zhou It is certified that error appears in the above-identified patent and that said Letters Patent is hereby corrected as shown below:

Column 6, Line 53, Claim 1, delete "seal: and" and insert --seal and,--.

Signed and Sealed this
Twenty-second Day of December, 2015

Michelle K. Lee

Michelle K. Lee
*Director of the United States Patent and Trademark Office*